US011292680B2

(12) United States Patent
Wick

(10) Patent No.: US 11,292,680 B2
(45) Date of Patent: Apr. 5, 2022

(54) SHEET FEEDER FOR A MACHINE FOR PROCESSING MATERIAL IN SHEET FORM, SUCH AS PAPER, CARDBOARD OR FILMS

(71) Applicant: BOBST GRENCHEN AG, Grenchen (CH)

(72) Inventor: Stefan Wick, Oberbuchsiten (CH)

(73) Assignee: Bobst Grenchen AG, Grenchen (CH)

( * ) Notice: Subject to any disclaimer, the term of this patent is extended or adjusted under 35 U.S.C. 154(b) by 0 days.

(21) Appl. No.: 16/651,223

(22) PCT Filed: Oct. 9, 2018

(86) PCT No.: PCT/EP2018/025262
§ 371 (c)(1),
(2) Date: Mar. 26, 2020

(87) PCT Pub. No.: WO2019/072415
PCT Pub. Date: Apr. 18, 2019

(65) Prior Publication Data

US 2020/0283249 A1 Sep. 10, 2020

(30) Foreign Application Priority Data

Oct. 10, 2017 (DE) ..... 102017123520.5

(51) Int. Cl.
*B65H 3/42* (2006.01)
*B65H 3/08* (2006.01)

(52) U.S. Cl.
CPC ..... *B65H 3/42* (2013.01); *B65H 3/0825* (2013.01); *B65H 3/0883* (2013.01); *B65H 2403/511* (2013.01); *B65H 2406/3452* (2013.01)

(58) Field of Classification Search
CPC ..... B65H 3/08; B65H 3/0808; B65H 3/0816; B65H 3/0825; B65H 3/42;
(Continued)

(56) References Cited

U.S. PATENT DOCUMENTS 3,386,558 A 6/1968 Benatar
3,831,930 A * 8/1974 Shimizu ..... B65H 3/0825 271/91
(Continued)

FOREIGN PATENT DOCUMENTS

CH 539567 A 7/1973
CN 106241439 A 12/2016
(Continued)

OTHER PUBLICATIONS

International Search Report dated Jan. 28, 2019, in counterpart International Patent Application No. PCT/EP2018/025262 (5 pages).

*Primary Examiner* — Prasad V Gokhale
(74) *Attorney, Agent, or Firm* — Bookoff McAndrews, PLLC

(57) ABSTRACT

Sheet feeder (4) for a machine (1) for the processing of sheet material such as paper or films, having a drive shaft (10), which extends substantially perpendicular to a sheet feeding direction and is provided with at least one suction gripper (12), which is rotated above the sheet material, when the drive shaft (10) is driven, wherein the suction gripper (12) is repositionable between an inactive position, in which it does not cooperate with the sheet material, and an active position, in which it can grip on the top side of the sheet material and carry this along.

19 Claims, 9 Drawing Sheets

Figure 1:
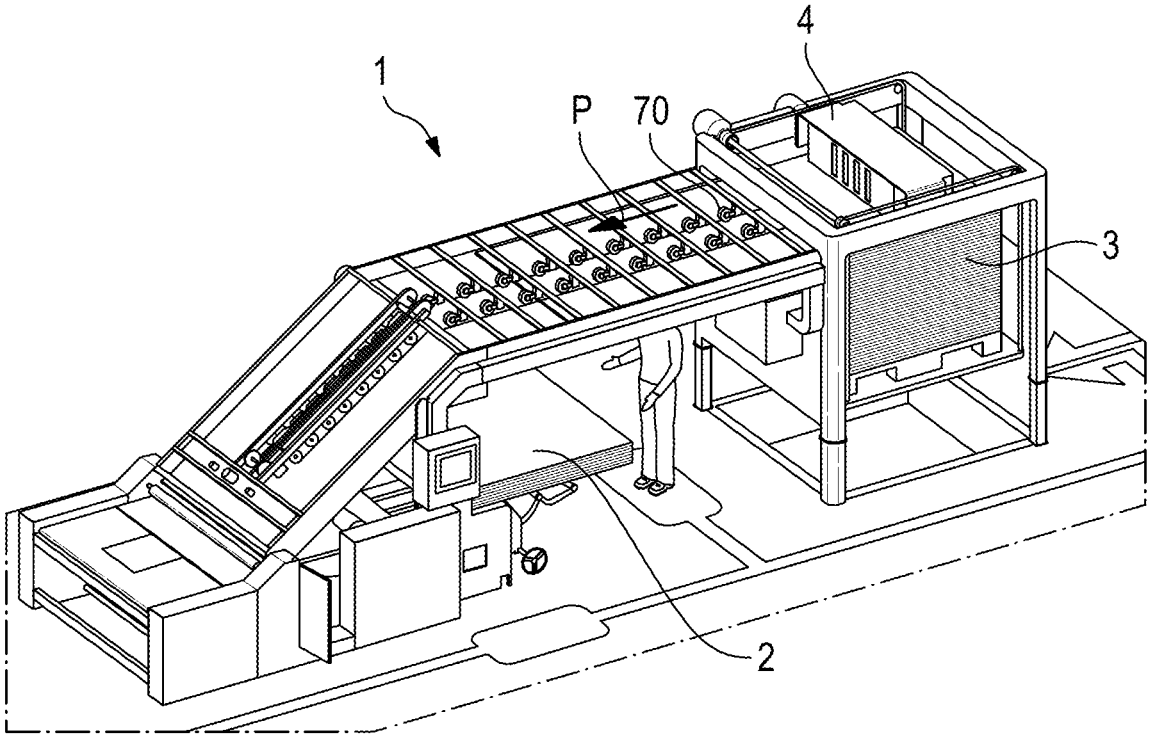

(58) Field of Classification Search
CPC ..... B65H 2403/511; B65H 2403/512; B65H 2406/345; B65H 2406/3452; B65H 3/0883
USPC ..... 271/91, 94, 95, 104, 107
See application file for complete search history.

(56) References Cited

U.S. PATENT DOCUMENTS

| | | | | |
|---|---|---|---|---|
| 3,836,139 | A * | 9/1974 | Shimizu | B65H 3/0825 271/95 |
| 5,102,385 | A * | 4/1992 | Calvert | B65B 43/305 493/315 |
| 5,700,004 | A * | 12/1997 | Bahr | B65H 3/085 271/171 |
| 6,325,201 | B1 | 12/2001 | Bailey et al. | |
| 7,481,420 | B2 * | 1/2009 | Iwamoto | B65H 1/22 271/149 |
| 7,695,421 | B2 * | 4/2010 | Ford | B65B 43/185 493/315 |
| 8,047,530 | B2 * | 11/2011 | Harston | B65B 43/185 271/91 |
| 10,501,220 | B2 * | 12/2019 | Sassi | B65B 5/024 |
| 2006/0162584 | A1 * | 7/2006 | Iwamoto | B65H 3/42 101/71 |
| 2007/0257416 | A1 * | 11/2007 | Ford | B65B 43/185 271/91 |
| 2019/0263617 | A1 * | 8/2019 | Yoshikane | B65B 43/16 |

FOREIGN PATENT DOCUMENTS

| | | | |
|---|---|---|---|
| DE | 2241910 | B2 | 6/1973 |
| DE | 68916955 | T2 | 11/1994 |
| DE | 19516045 | A1 | 11/1996 |
| DE | 69118262 | T2 | 12/1996 |
| GB | 2302082 | B | 7/1998 |
| JP | S5020885 | B | 7/1975 |
| WO | 2007136242 | A1 | 11/2007 |

* cited by examiner

SHEET FEEDER FOR A MACHINE FOR PROCESSING MATERIAL IN SHEET FORM, SUCH AS PAPER, CARDBOARD OR FILMS

CROSS-REFERENCE TO RELATED APPLICATION(S)

This application is a National Stage under 35 U.S.C. § 371 of International Application No. PCT/EP2018/025262, filed on Oct. 9, 2018, which claims priority to German Patent Application No. 102017123520.5, filed Oct. 10, 2017, the contents of all of which are incorporated by reference in their entirety.

The invention relates to a sheet feeder for a machine for the processing of sheet material such as paper, cardboard or films.

The machine can be a laminating machine, which applies a coating material, for example a plastic film, onto a substrate and bonds the two firmly together. The machine can also be for example a machine for the manufacture of corrugated cardboard. Other examples of applications are however also conceivable.

The sheet feeder serves to grip the respective topmost sheet from a stack of staged sheets and remove it from the stack in a sheet feeding direction, such that the topmost sheet can then be processed further.

Known from the prior art for this purpose are vacuum grippers, which are placed translationally from above onto the topmost sheet of the stack and then lift said sheet vertically from the stack. Thereupon the sheet lifted from the stack is grasped by other grippers and moved further translationally in the sheet feeding direction.

The object of the invention consists in creating a device that is simpler with regard to its construction.

To achieve this object, according to the invention a sheet feeder is provided, having a drive shaft, which extends substantially perpendicular to a sheet feeding direction and is provided with at least one suction gripper, which is rotated above the sheet material, when the drive shaft is driven, wherein the suction gripper is repositionable between an inactive position, in which it does not cooperate with the sheet material, and an active position, in which it can grip on the top side of the sheet material and carry this along. The invention is based on the fundamental idea of combining the two movement components (namely vertical and horizontal) known from the prior art into a single, flowing movement. For this purpose the suction gripper rotates above the stack of sheet material, whereby, during a suitable section of its movement path, it grips the topmost sheet of the stack, lifts it up and carries it along. It is therefore no longer necessary to pass on the sheet from a first device, which lifts it up, to a second device, which moves it away from the stack and pushes it forwards.

Preferably multiple suction grippers are provided, which are arranged in multiple groups, which are spaced apart from one another in axial direction of the drive shaft. In this connection the expedient number of groups and the spacing of the groups in relation to one another depend on the characteristics of the sheets to be removed from the stack. In this connection between four and ten groups are particularly preferred.

According to one embodiment of the invention it is provided, that each group has multiple suction grippers, which are spaced apart from one another in circumferential direction around the drive shaft. This makes it possible to increase the number of cycles.

Particularly preferably each group has three suction grippers. In this case, when a suction gripper has grasped the topmost sheet, lifted it up and pushed it slightly forwards, the next suction gripper is already being advanced.

Preferably each suction gripper has a body and a suction cup repositionable relative thereto, the body being attached at a distance from the central axis of the drive shaft. The size of the radius, on which the body of each suction gripper is attached, has a decisive influence on the distance that the topmost sheet can be pushed forwards, when the corresponding suction gripper grips it.

The bodies are preferably rotatably attached relative to the drive shaft, such that the front side of the suction grippers, which grips the sheets, can be held parallel to the plane of the sheets over a certain portion of the movement of the suction grippers.

The radius, on which the body is moved around the drive shaft, is preferably variable, such that the vertical and the horizontal components of the movement of the suction grippers are controlled in the desired manner.

Here a repositioning mechanism can be provided, with which the position and alignment of the suction grippers is controlled relative to a plane, in which the sheets are located. With the repositioning mechanism the movement path of the suction grippers can be controlled, such that, despite the rotational movement of the drive shaft, they move (at least almost) parallel to the plane of the sheets over a certain distance.

According to one embodiment of the invention the drive axle has multiple holding rods, which extend parallel to the axis of rotation of the drive shaft and to which the bodies of the suction grippers are attached. The holding rods make it possible to reposition all those suction grippers, which, viewed in the circumferential direction, are attached in the same position, simultaneously and easily.

Preferably the holding rods are rotatable and displaceable relative to the drive shaft, such that both the alignment and also the radius, on which the suction grippers are located at each point of their movement path, can be controlled in the desired manner.

The position and the rotation of the holding rods are repositioned preferably by means of the repositioning mechanism. According to a simple embodiment this can have a cam track and a cam follower. In this way no servo motors or similar complicated components are required; instead, the desired repositioning of the holding rods can be achieved in a purely mechanical way.

According to one embodiment of the invention at least one pneumatic channel, with which the suction gripper is connected, is integrated into the drive shaft. This makes it possible to be able to supply fairly easily the compressed air or a vacuum necessary for activating the suction grippers.

Depending on the embodiment of the control system for the pneumatics and the suction grippers, a dedicated pneumatic channel can be provided inside the drive shaft for each holding rod.

According to one embodiment of the invention a hold-down device is provided, which cooperates in a suitable manner with the sheets located on the stack, when the suction grippers lift up the topmost sheet.

Figure 2:
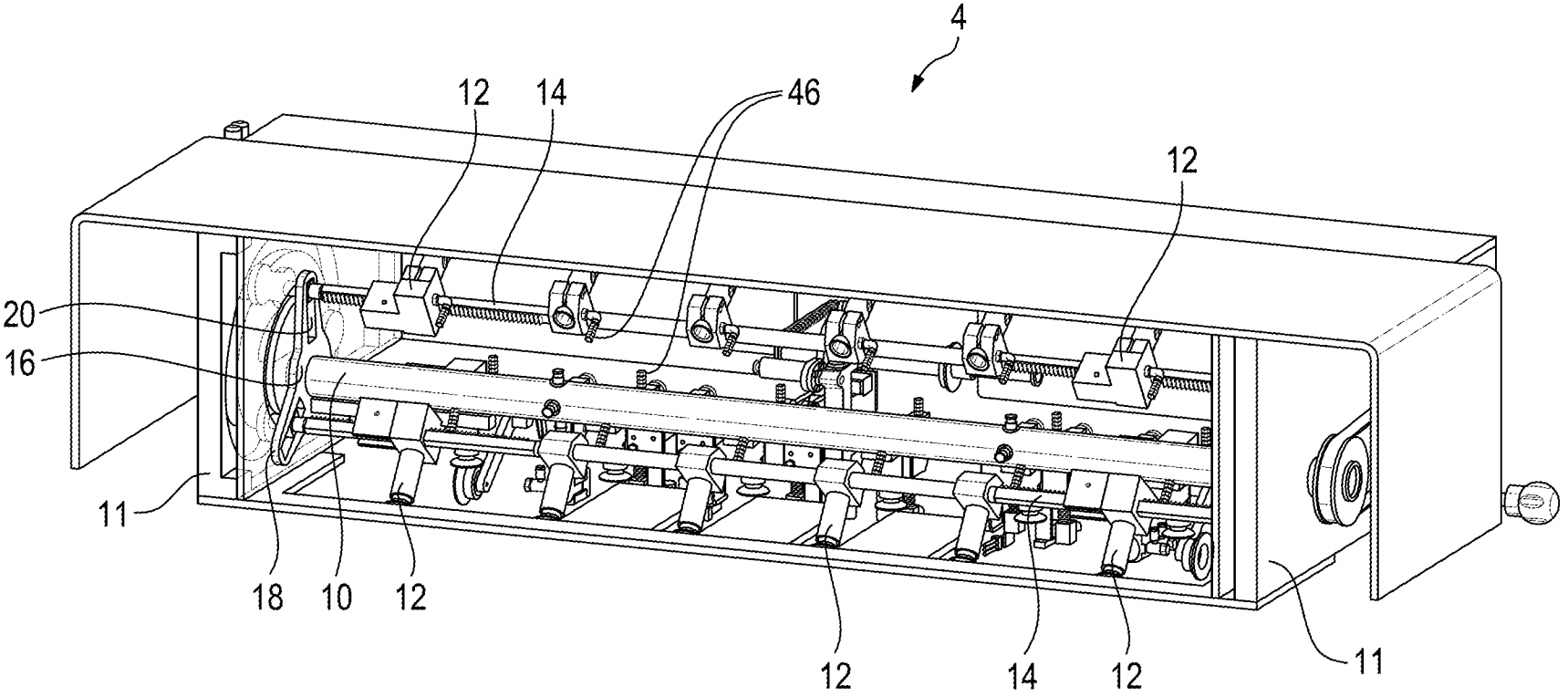
Figure 3:
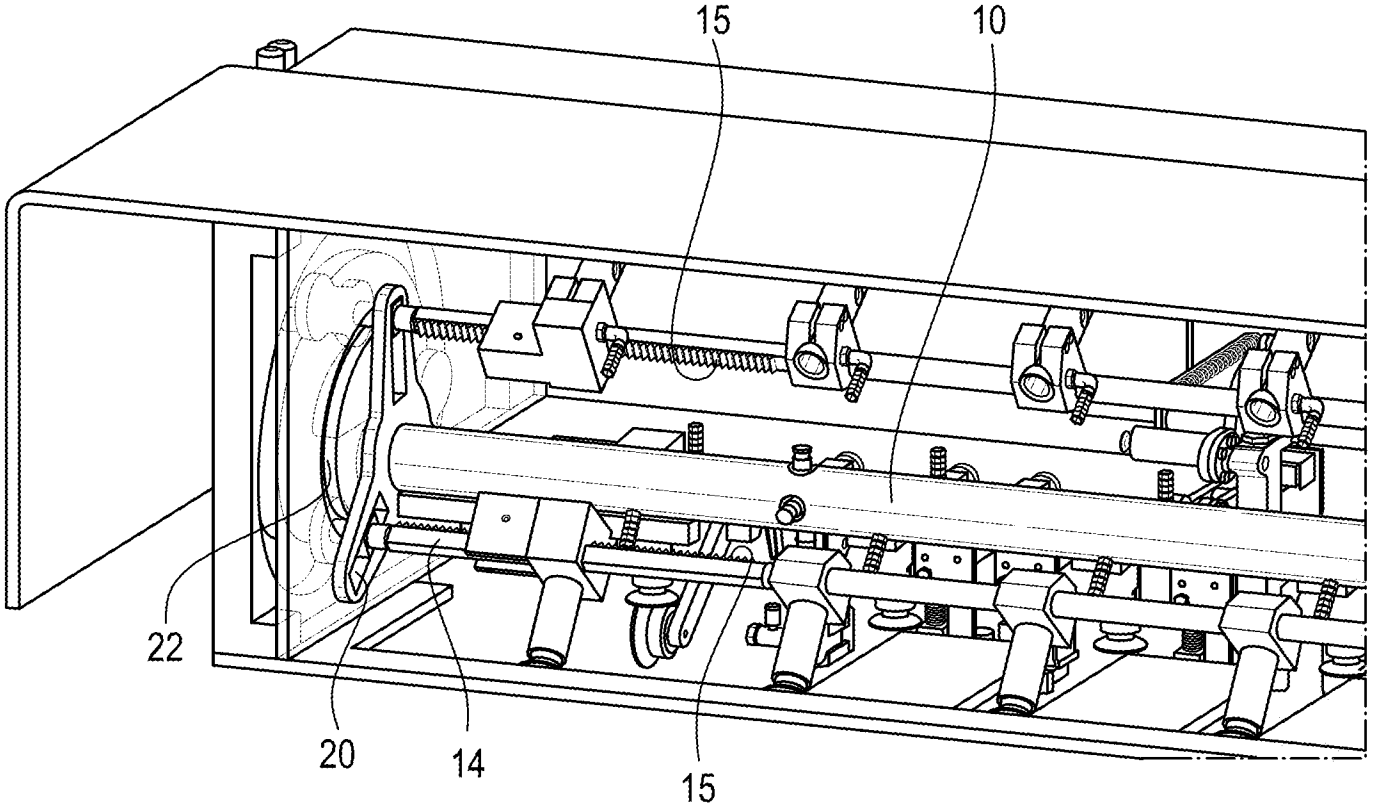
Figure 4:
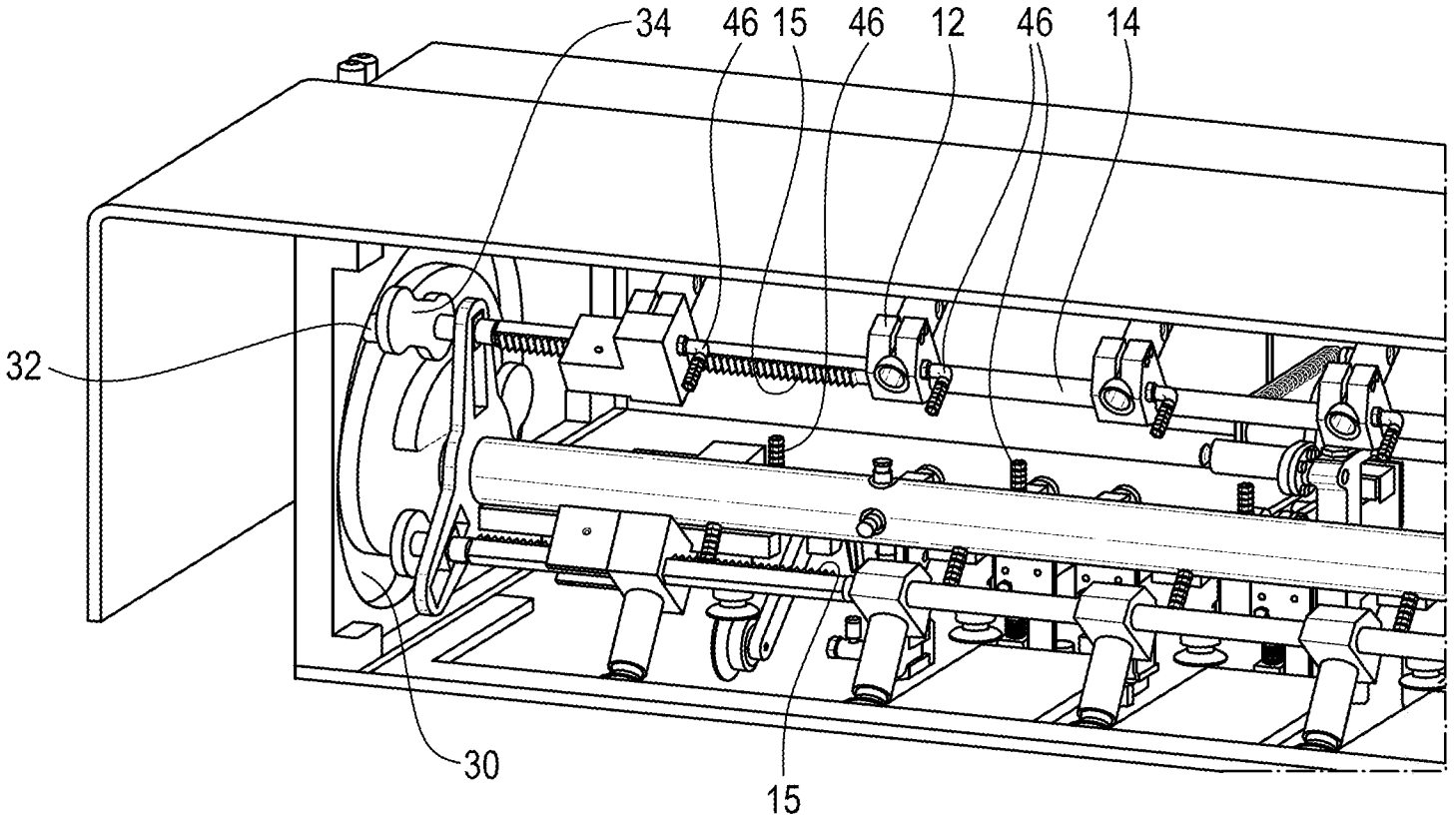
Figure 5:
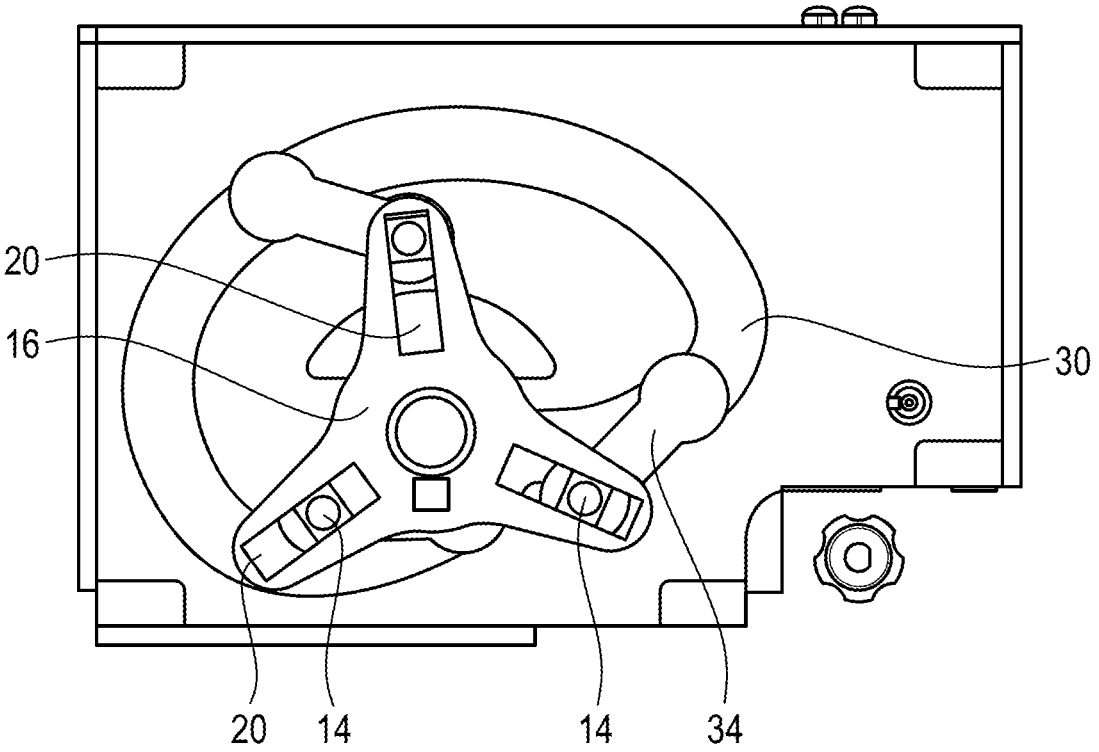
Figure 6:
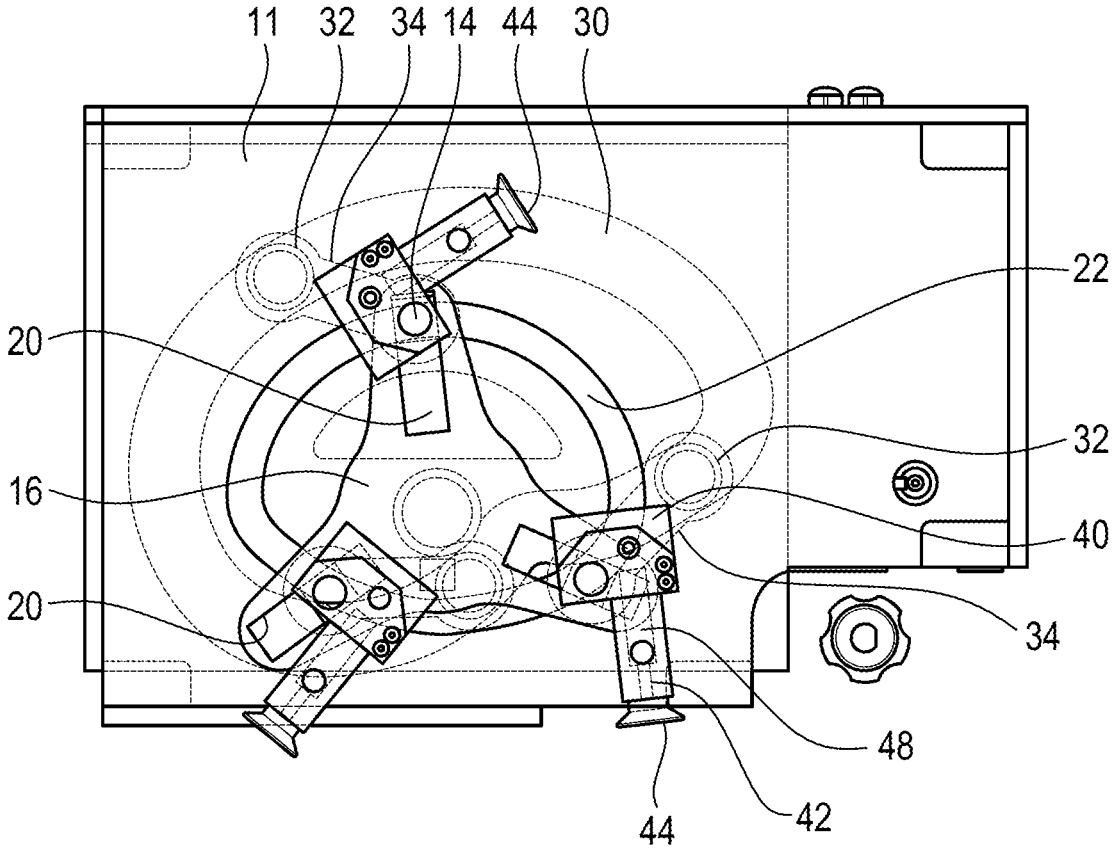

The invention is described below with the help of one embodiment, which is represented in the appended drawings, where the following are shown:

FIG. 1 schematically an example of a machine for the processing of sheet material;

FIG. 2 in a schematic, perspective view the essential part of the sheet feeder;

FIG. 3 in an enlarged view a part of the sheet feeder from FIG. 2;

FIG. 4 the part of the sheet feeder represented in FIG. 3, with a part of the frame omitted, so that the part behind it can be seen;

FIG. 5 in a schematic top view the link guide visible in FIG. 4;

FIG. 6 in a schematic top view a group of suction grippers together with their repositioning mechanism;

FIGS. 7 to 12 in a schematic representation the various steps of the removal of the topmost sheet from a stack.

In FIG. 1 a machine 1 can be seen, which serves to process sheet material. In the example shown the machine serves to bond two sheets together, for example to laminate one onto the other.

A first stack of sheets is marked with the reference sign 2 and a second stack of sheets is marked with the reference sign 3. In operation one sheet from stack 2 is joined respectively with one sheet from stack 3, for example they are stuck together.

The individual sheets can be sheets of paper, plastic film, cardboard or similar materials.

In order to remove individual sheets from the stacks, a sheet feeder is provided. By way of example this is given the reference sign 4 on stack 3.

The sheet feeder 4 is explained in more detail below with the help of FIGS. 2 to 7.

An essential part of the sheet feeder 4 is a drive shaft 10, which is arranged above the plane, in which the topmost sheet of the stack 3 is located. In this connection the drive shaft 10 extends parallel to this plane and perpendicular to the direction, in which each sheet removed from the stack 3 is then transported further (see the arrow P in FIG. 1; this direction is also referred to as sheet feeding direction).

For the mounting of the drive shaft 10 and the other relevant components of the sheet feeder a frame 11 is provided, which is arranged above the place where the stack 3 is located.

Multiple suction grippers 12 are arranged on the drive shaft 10. The suction grippers 12 serve to grip the respective topmost sheet of the stack and to move it forwards relative to the stack 3 in the direction of the arrow P.

The suction grippers 12 are arranged at a distance from the axis of rotation of the drive shaft 10, such that, when the drive shaft 10 is driven, they move along a closed movement path around the rotational axis.

The suction grippers 12 are arranged in various groups spaced apart from one another in axial direction. As can be seen in FIG. 2, six groups of suction grippers 12 in total are provided along the rotational axis of the drive shaft 10. As can be seen in FIG. 3, each group of suction grippers here contains three suction grippers 12.

The suction grippers 12 are distributed over a total of three holding rods 14, which all extend parallel to the rotational axis of the drive shaft 10. Viewed in circumferential direction, the holding rods 14 are arranged at an angular distance of 120° relative to one another.

More particularly in FIGS. 3 and 4 it can be seen that the outside groups of suction grippers 12 are repositionable in axial direction (see the toothed racks 15). This makes it possible to set the working width of the sheet feeder for different formats.

The three holding rods 14 are mounted in two holding elements 16, which are arranged at opposite axial ends of the drive shaft 10. Each holding element 16 has three holding arms 18 extending in radial direction, whereby in each holding arm 18 a guide slot 20 is provided, which extends radially and in which one end of a holding rod 14 is accommodated.

The guide slots 20 make it possible for the holding rods 14 to reposition themselves in radial direction relative to the rotational axis of the drive shaft 10.

The radius, on which each holding rod 14 is located, is determined by a guide track 22, which can be seen more particularly in FIG. 3. The guide track 22 has a circular configuration in the widest sense, whereby it is flattened on the side facing the stack 3.

In this connection the guide track 22 is provided in one of the end plates of the frame 11, in which the drive shaft 10 is also mounted.

When the drive shaft 10 rotates, the holding rods 14 are not only repositioned upon every revolution with regard to the radial distance from the rotational axis, but in each case also turned within certain limits relative to the corresponding holding arm 18. In order to control this turning, a cam track 30 (see more particularly FIG. 4) is provided, in which multiple cam followers 32 run. In this connection each cam follower 32 is coupled with a holding rod 14 by way of a connecting rod 34.

The guide slots 20 together with the guide track 22 and also the cam track 30 with the cam followers 32 form a repositioning mechanism, with which the position and alignment of the suction gripper 12 is controlled upon each rotation of the drive shaft 10. In general terms each suction gripper 12 is moved hereby, such that its "front side", i.e. the suction cup to be placed on the corresponding sheet, is aligned parallel to the plane of the corresponding sheet, as long as the suction gripper cooperates with the sheet. Thereupon the corresponding suction gripper 12 is transferred again "overhead" into a position, in which it can again grip a sheet.

Because of this sequence of movements the cam track, viewed in an axial direction, usually lies outside the guide track 22.

Each suction gripper 12 has a body 40 (see FIG. 3), which is fastened non-rotationally on one of the holding rods 14. Mounted displaceably in the body 40 is a telescopically extendable ram 42, on the front side of which the actual suction cup 44 is attached.

Arranged inside the body 40 is a return spring 48 (see FIG. 6), which forces the ram 42 into a retracted position, in which the suction cup 44 is repositioned towards the body 40.

The suction grippers 12 are activated with compressed air and contain a Venturi nozzle, such that the desired vacuum can be generated at the suction cup 44. The compressed air supplied to activate the suction cup 44 leads to the ram 42 being repositioned telescopically outwards out of the body 40 against the action of the return spring.

The compressed air is supplied inside the drive shaft 10 in a pneumatic channel and is passed from there to the body 40 via connection nozzles 46 visible in FIG. 2; for the sake of clarity the hoses attached to the connection nozzles 46 are not represented here.

Depending on the nature of the control system and of the suction grippers, a single pneumatic channel can be provided, to which all suction grippers are connected, or a separate pneumatic channel can be provided for the suction grippers of each holding rod.

The principle of operation of the sheet feeder 4 is explained below with the help of FIGS. 7 to 12. In this connection by way of example one of the suction grippers 12 of a group of suction grippers is considered, whereby the corresponding suction device is characterised with a black dot, so it can be tracked more easily.

The drive shaft 10 rotates clockwise in relation to FIGS. 7 to 12, in order to remove the respective topmost sheet of the stack 3 from the stack in the direction of the arrow P, such that it can be processed further.

Figure 7:
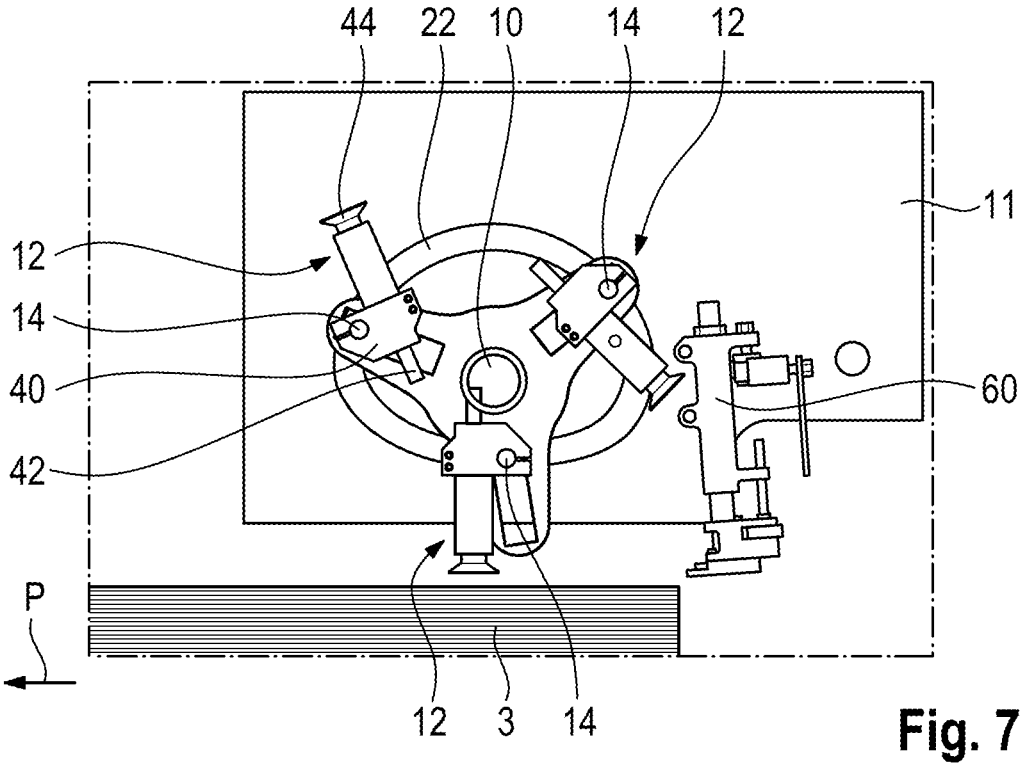
Figure 8:
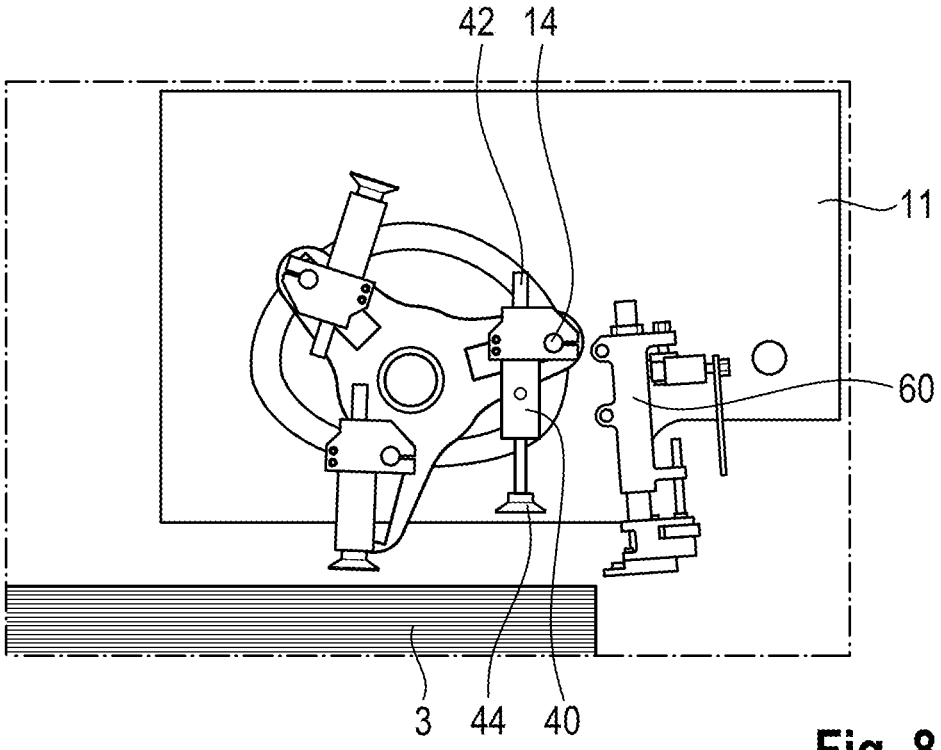
Figure 9:
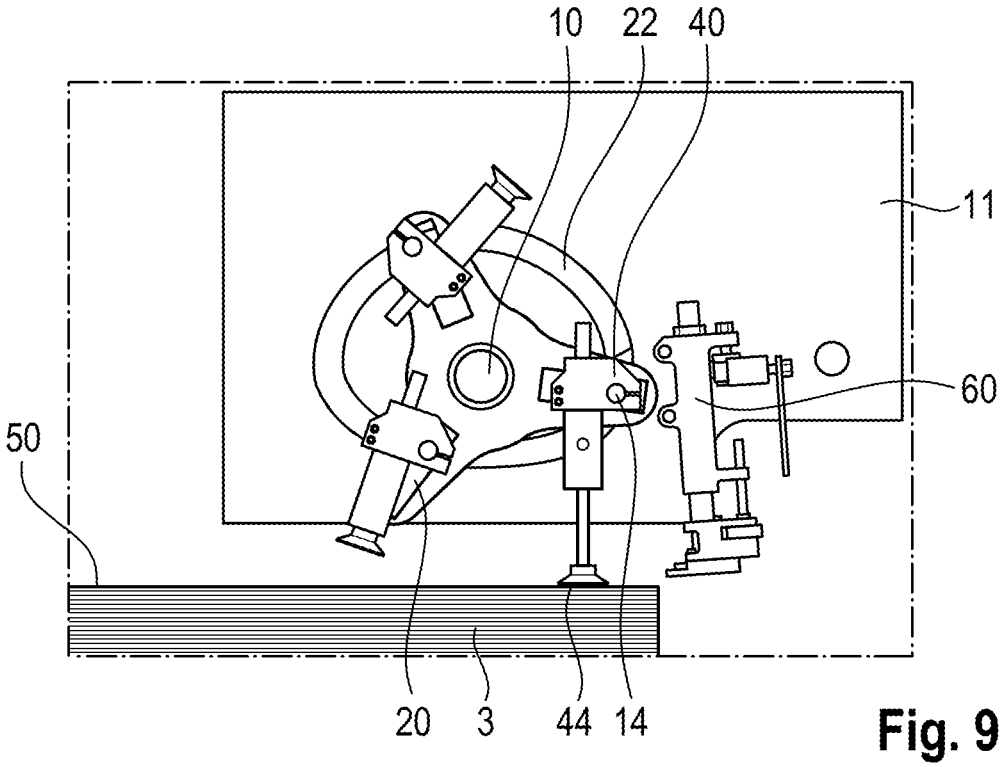
Figure 10:
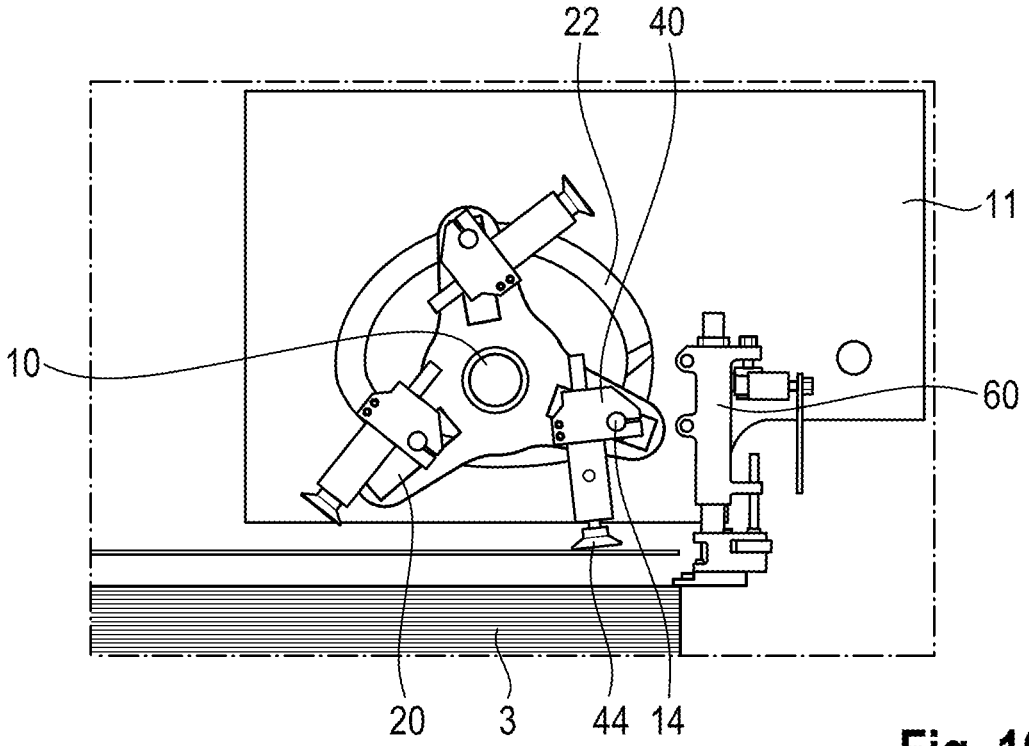
Figure 11:
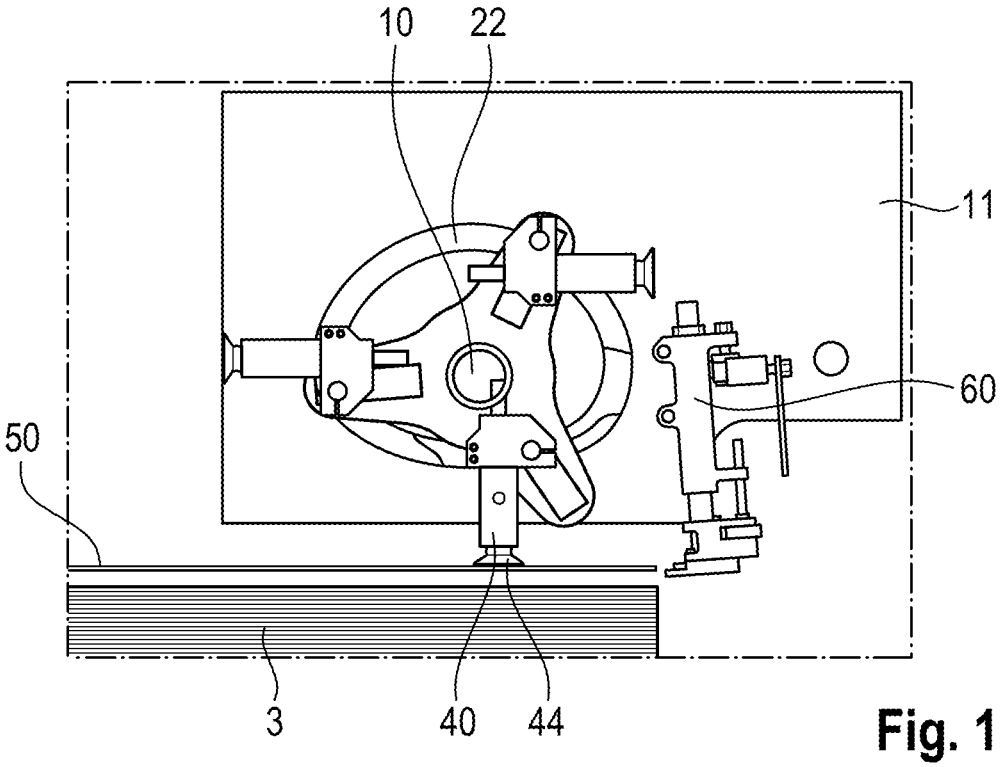

The suction gripper 12 viewed here is brought close to the stack 3 from above, whereby it is turned by means of the repositioning mechanism, more particularly by means of the cam track 30 and the corresponding cam follower 32, such that the ram 42 is located approximately perpendicular to the plane of the topmost sheet of the stack 3 (cf. FIGS. 7 and 8). In this connection the holding rod 14 is located on a relatively large radius.

When the suction gripper 12 is being advanced towards the stack 3, the ram 42 is also extended out together with the suction cup 44 (cf. again FIGS. 7 and 8). When the drive shaft 10 has been rotated sufficiently further, the suction cup 44 rests on the topmost sheet 50 of the stack 3 (see FIG. 9).

After the suction cup 44 is resting on the sheet 50 and accordingly the suction cup there is sealed, the compressed-air supply of the suction gripper 12 is set, such that the return spring retracts the ram 42 into the body 40, while at the same time the vacuum on the suction cup 44 continues to act. In this way the sheet 50 is lifted from the stack 3 (see FIG. 10). At the same time a hold-down device 60 is activated, which secures the sheet lying underneath on the stack 3.

It is also possible to assist the separation of the topmost sheet from the stack through the blowing-in of air in a per se known manner.

Upon further rotation of the drive shaft 10 the suction gripper 12 is moved further clockwise (see FIG. 11), executing a substantially translational movement parallel to the plane of the sheets in the stack 3 and in the direction of the arrow P on account of the guide track 22.

Figure 12:
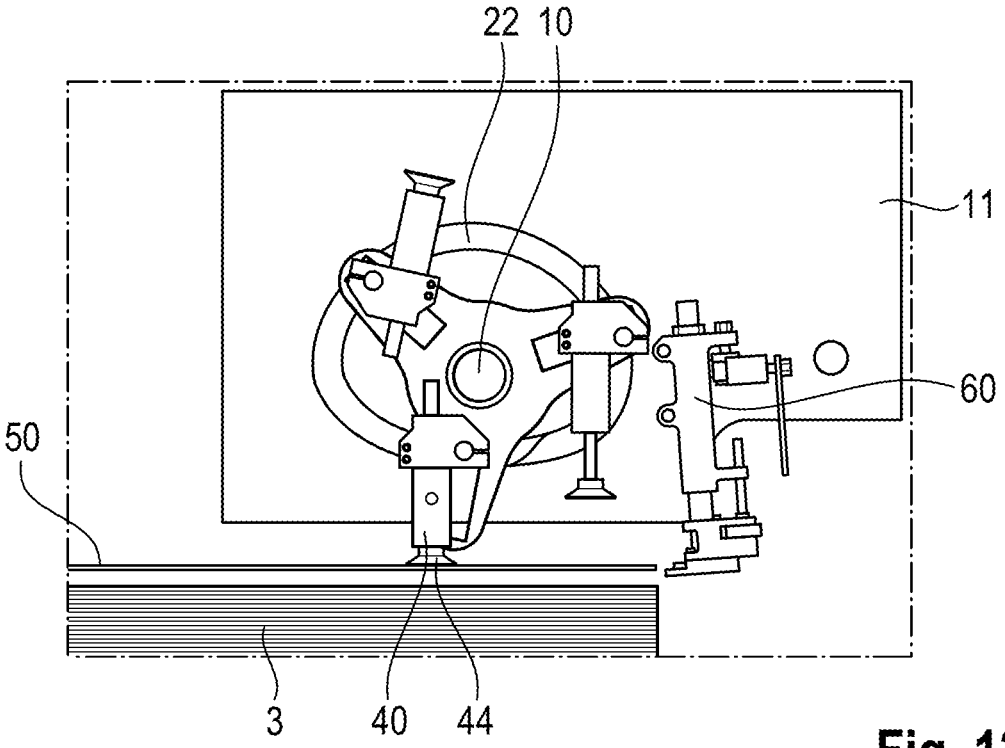

FIG. 12 shows the state, in which the sheet 50 was repositioned so far to the left that it is grabbed by a conveyor 70 shown schematically in FIG. 1. At about the same time the suction cup 44 is deactivated, such that the sheet is released. In FIG. 8 it can be seen that in this state the next suction cup is then already being brought close to the then topmost sheet of the stack 3, such that the next sheet can be grabbed and supplied to the conveyor 70.

The drive shaft 10 does not necessarily have to be embodied as unified component extending along the rotational axis, around which the suction grippers 12 are repositioned. Instead, other designs are also conceivable. All that is important, is that the suction grippers 12 can be moved along a circular path around a rotational axis.

The invention claimed is:

1. A sheet feeder for a machine for processing of sheet material, comprising:

a drive shaft, which extends substantially perpendicular to a sheet feeding direction and is provided with at least one suction gripper, which is rotated above the sheet material, when the drive shaft is driven, wherein the suction gripper is repositionable between an inactive position, in which a ram of the suction gripper is provided in a retracted position so that the suction gripper does not cooperate with the sheet material, and an active position, in which the ram of the suction gripper is provided in an extended position so that the suction gripper can grip on a top side of the sheet material and carry the sheet material along, and wherein at least one pneumatic channel, with which the suction gripper is connected, is integrated into the drive shaft to extend the ram from the retracted position to the extended position.

2. The sheet feeder according to claim 1, wherein the at least one suction gripper is one of multiple suction grippers provided in multiple groups, which are spaced apart from one another in axial direction of the drive shaft.

3. The sheet feeder according to claim 2, wherein each group has three suction grippers, which are spaced apart from one another in circumferential direction around the drive shaft.

4. The sheet feeder according to claim 1, wherein the suction gripper further comprises a return spring configured to return the ram from the extended position to the retracted position.

5. The sheet feeder according to claim 1, wherein the ram of the suction gripper telescopically extends from the retracted position to the extended position.

6. The sheet feeder according to claim 1, wherein each suction gripper has a body, the ram, and a suction cup attached to the ram to be repositionable relative to the body, the body being attached at a distance from a central axis of the drive shaft.

7. The sheet feeder according to claim 6, wherein the body is rotatably attached relative to the drive shaft, and the ram telescopically extends relative to the body from the retracted position to the extended position.

8. The sheet feeder according to claim 1, wherein a pneumatic channel is provided for each holding rod.

9. The sheet feeder according to claim 1, wherein the at least one pneumatic channel is additionally configured to supply air to the suction gripper to generate a vacuum in a suction cup attached to the ram.

10. A sheet feeder for a machine for processing of sheet material, comprising:

a drive shaft, which extends substantially perpendicular to a sheet feeding direction and is provided with at least one suction gripper, which is rotated above the sheet material, when the drive shaft is driven, wherein the suction gripper is repositionable between an inactive position, in which a ram of the suction gripper is provided in a retracted position so that the suction gripper does not cooperate with the sheet material, and an active position, in which the ram of the suction gripper is provided in an extended position so that the suction gripper can grip on a top side of the sheet material and carry the sheet material along, wherein each suction gripper has a body, the ram, and a suction cup attached to the ram to be repositionable relative to the body, the body being attached at a distance from a central axis of the drive shaft, and wherein a radius, on which the body is moved around the drive shaft, is variable.

11. The sheet feeder according to claim 10, wherein a repositioning mechanism is provided, with which the position and alignment of the suction gripper is controlled relative to a plane, in which the sheets are located.

12. The sheet feeder according to claim 11, wherein a drive axle has multiple holding rods, which extend parallel to the axis of rotation of the drive shaft and to which the body of the suction gripper is attached.

13. The sheet feeder according to claim 12, wherein the holding rods are rotatable and displaceable relative to the drive shaft.

14. The sheet feeder according to claim 12, wherein the repositioning mechanism repositions the holding rods.

15. The sheet feeder according to claim 14, wherein the repositioning mechanism has a cam track and a cam follower.

16. A sheet feeder for a machine for processing of sheet material, comprising:

a drive shaft, which extends substantially perpendicular to a sheet feeding direction;

a holding arm provided on the drive shaft, and including a guide slot extending in a radial direction of the drive shaft;

a guide track;

a holding rod provided in the guide track and in the guide slot, repositionable in the guide slot in the radial direction of the drive shaft, and extending substantially parallel to the drive shaft; and a suction gripper provided on the holding rod, which is rotated above the sheet material when the drive shaft is driven, wherein the suction gripper is repositionable between an inactive position, in which the suction gripper does not cooperate with the sheet material, and an active position, in which the suction gripper can grip on a top side of the sheet material and carry the sheet material along.

17. The sheet feeder according to claim 16, further comprising:

a cam track;

a cam follower provided in the cam track; and a connecting rod connected to the cam follower and coupled to the holding rod.

18. The sheet feeder according to claim 17, wherein when the drive shaft is driven:

the holding arm rotates around the drive shaft, and the holding rod is repositioned in the guide slot in the radial direction of the drive shaft based on a rotation of the holding rod around the drive shaft in the guide track, and is rotated in the guide slot based on the connecting rod connected to the cam follower in the cam track.

19. The sheet feeder according to claim 17, wherein the suction gripper is repositioned based on the position and rotation of the holding rod.

* * * * *